United States Patent [19]

Brisco

[11] 4,290,482

[45] Sep. 22, 1981

[54] PLUG CONTAINER

[75] Inventor: David P. Brisco, Duncan, Okla.

[73] Assignee: Halliburton Company, Duncan, Okla.

[21] Appl. No.: 145,185

[22] Filed: Apr. 29, 1980

[51] Int. Cl.[3] ..... E21B 33/03; E21B 33/14; E21B 33/16

[52] U.S. Cl. ..... 166/70; 166/90; 166/113

[58] Field of Search ..... 166/70, 69, 90, 88, 166/86, 96, 97, 75 R, 113; 137/268; 15/104.06 A

[56] References Cited

U.S. PATENT DOCUMENTS

| | | | |
|---|---|---|---|
| 1,566,419 | 12/1925 | O'Neill et al. | 166/90 |
| 1,567,097 | 12/1925 | Anthony | 166/90 |
| 1,791,874 | 2/1931 | Rodgers | 166/70 X |
| 1,963,046 | 6/1934 | Bouslog | 166/88 |
| 2,615,519 | 10/1952 | Carr | 166/70 |
| 2,620,037 | 12/1952 | McClendon | 166/70 |
| 2,854,079 | 9/1958 | Schnitter | 166/70 |
| 3,216,500 | 11/1965 | Diehl | 15/104.06 A X |
| 4,093,028 | 6/1978 | Brandon | 166/291 X |
| 4,169,504 | 10/1979 | Scott | 166/90 |

*Primary Examiner*—Stephen J. Novosad
*Attorney, Agent, or Firm*—John H. Tregoning; James R. Duzan

[57] ABSTRACT

Cementing plug container having improved fluid inlets thereto.

3 Claims, 3 Drawing Figures

PLUG CONTAINER

BACKGROUND OF THE PRIOR ART

This invention relates to an improved plug container for well cementing operations.

Prior to the cementing of casing in an oil or gas well, in most instances, continuity of the circulation of fluids in the well bore around the outside of the casing from the interior thereof is desired as a precautionary measure to help in preventing the casing from sticking. Rather than opening the top of the casing to insert cementing plugs therein prior to the cementing operation, a plug container in which the cementing plugs are initially contained is installed on the top of the casing having flow lines and cementing lines connected thereto.

A typical prior art plug container is shown in Halliburton Sales and Service Catalog Number 39, page 3138. The prior art plug container shown on page 3138 is designed for continuous operation in casing cementing operations. The bottom cementing plug is inserted through the plug container into the casing before the mixing of cement starts. The top cementing plug is inserted or loaded into the plug container, resting on the releasing pin contained therein, at the same time as the insertion of the bottom cementing plug. The top cementing plug is released to follow the cement down the casing, by turning the releasing handle connected to the releasing pin. A lever type indicator installed in the plug container shows the passage of the top cementing plug as it leaves the plug container and enters the casing.

The design of this prior art plug container permits the use of multiple plug containers in series, the top thread of one mating with the bottom thread of the other, after the removal of the lower nipple from the upper plug container. In this manner, a double plug container is created having continuous operating capabilities. Utilizing a double plug container, the bottom cementing plug is released ahead of the cement while the top cementing plug is released behind the cement.

Typically, this prior art plug container is constructed from a casting having the fluid inlet ports to the plug container being located approximately perpendicular to the bore through the plug container through which the cementing plugs pass. While this prior art plug container is simple to construct, obtaining crack-free castings to manufacture the plug container can be a problem. Also, since the fluid inlets to the plug container enter approximately perpendicular to the bore of the plug container, in some instances, the cementing plug may never be pumped down the casing after being released by the releasing pin because the cementing plug may float in the plug container on the cement being pumped therethrough without being carried downwardly therewith.

Another typical prior art plug container is constructed as a weldment having the fluid inlet ports to the plug container being located approximately perpendicular to the bore through the plug container through which the cementing plugs pass. Since this plug container is simple to construct and is fabricated as a weldment, it is not subject to cracks during casting operations. However, since the fluid inlets to the plug container enter approximately perpendicular to the bore of the plug container, in some instances, the cementing plug may never be pumped down the casing after being released by the releasing pin because the cementing plug may float in the plug container on the cement being pumped therethrough without being carried downwardly therewith.

SUMMARY OF THE INVENTION

In contrast to the prior art, the present invention is directed to a plug container that is easy to manufacture and provides an improved fluid flow into and through the plug container to assist in causing the cementing plug container therein to be pumped therefrom into the casing.

The present invention will be more fully understood from the following specification taken in conjunction with the drawings therein:

DESCRIPTION OF THE INVENTION

Figure 1:
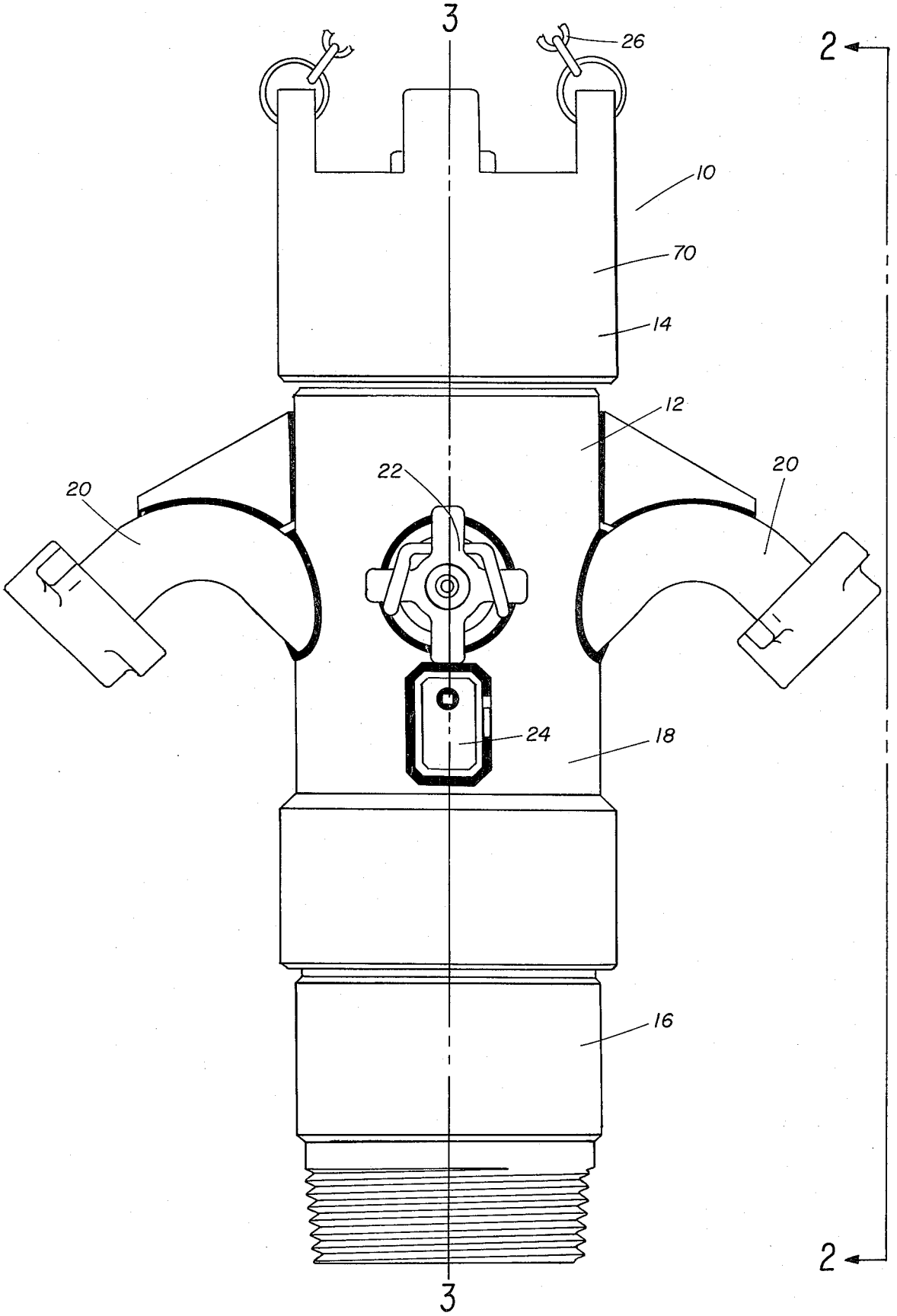
FIG. 1 is a front view of the present invention.

Referring to FIG. 1, the preferred embodiment of the plug container 10 of the present invention is shown.

The plug container 10 comprises a plug body 12, cap 14 and plug body nipple 16.

The plug body 12 comprises a cylindrical body member 18 having fluid inlets 20 thereon, having plug release plunger assembly 22 thereon and having plug release indicator assembly 24 thereon.

The cap 14 comprises a cylindrical cap member 70 having lifting means 26 thereon, the cap 14 threadedly engaging the plug body 12.

The plug body nipple 16 comprises a cylindrical member 82 threadedly engaging one end of the plug body 12 and having the other end thereof exteriorly threaded to engage drill pipe casing.

Figure 2:
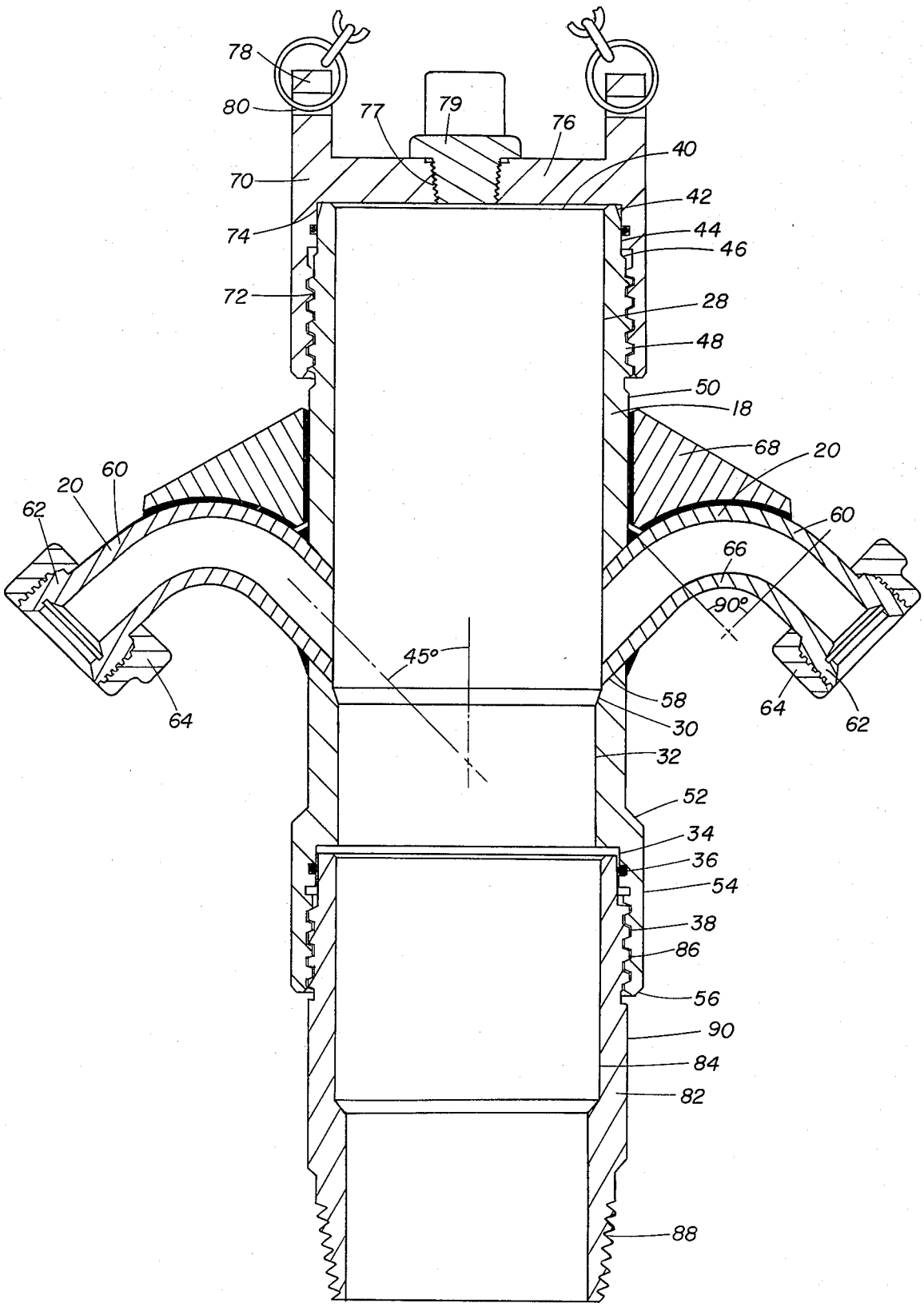
FIG. 2 is a cross-sectional view taken along line 2—2 of FIG. 1 of the present invention.

Referring to FIG. 2, the plug container 10 of the present invention is shown in cross-section along line 2—2 of FIG. 1.

As shown, the plug body 12 comprises cylindrical body member 18 having fluid inlets 20 thereon. The cylindrical member 18 is formed having a first bore 28, annular chamfered surface 30, second bore 32 having a smaller diameter than first bore 28, third bore 34 having annular recess 36 therein, the third bore 34 having a diameter larger than second bore 32, and threaded bore 38, the threaded bore being larger than third bore 34. The inlet of the first bore 28 may have chamfered surface 40 thereon. The body member 18 is further formed having the exterior thereof comprising first annular surface 42, first cylindrical surface 44, second annular surface 46, threaded portion 48, second cylindrical surface 50, third annular surface 52, third cylindrical surface 54 and fourth annular surface 56. Located in second cylindrical surface 50 are a plurality of apertures 58 through which fluid inlets 20 extend. The apertures 58 extend through the wall of cylindrical member 18 at approximately forty-five degrees (45°) with respect to the longitudinal axis of the bore 28.

Each fluid inlet 20 comprises a conduit member 60 having one end secured to the plug body 12, having a threaded fluid connection means 62 secured to the other end thereof and having a removable thread protector means 64 temporarily secured to the threaded fluid connection means 62 and slidable over the conduit member 60 when removed from the threaded fluid connection means 62. The fluid inlet 20 may be secured by any suitable means, such as welding, to the plug body 12. It is also preferred that each fluid inlet conduit member 60 be arcuately shaped having an approximately ninety degree (90°) angular portion 66 therein. When the fluid inlet 20 is installed on the plug body 12 being secured thereto having the threaded fluid connection means 62 directed generally toward the third cylindrical surface 54 of the plug body 12, when a conduit (not shown) is attached to the threaded fluid connection means 62 having its weight bearing thereon, the loading or stress at the point of attachment of the fluid inlet 20 to the plug body 12 is reduced or lessened over that of having the fluid inlet 20 installed at approximately ninety degrees (90°) to the bore of the plug body 12 through which the cementing plugs (not shown) pass.

To reinforce each fluid inlet 20, a reinforcing means 68 is secured to each fluid inlet conduit member 60 and the plug body 12. The reinforcing means 68 may be secured to the fluid inlet conduit member 60 and plug body 12 by any convenient means, such as welding. The reinforcing means 68 may also be installed on second cylindrical surface 50 on either the upper side (the cap 14 side) or lower side (the plug body adapter 16 side) of the fluid inlet 20. The reinforcing means 68 may be any suitable or desirable cross-sectional shape.

The cap 14 comprises a cylindrical cap member 70 having threaded bore 72 therein having cylindrical bore 74 therein, having threaded aperture 77, threadedly receiving top 76 thereon having a threaded plug 79 therein, and having a plurality of lug means 78 thereon having, in turn, apertures 80 therein. The lifting means 26 (not shown) are secured in apertures 80 when installed on the cap 14. The threaded bore 72 releasably engages threaded portion 48 of the exterior of the plug body 12.

The plug body nipple 16 comprises a cylindrical member 82 having a bore 84 therethrough, having threaded portion 86 on the exterior of one end thereof, threaded portion 88 on the exterior of the other end thereof and cylindrical surface 90 thereon intermediate the threaded portions 86 and 88. The threaded portion 86 releasably engages threaded bore 38 of the plug body 12. The threaded portion 88 releasably threadedly engages the drill pipe casing (not shown) to which the plug container 10 is temporarily installed.

Figure 3:
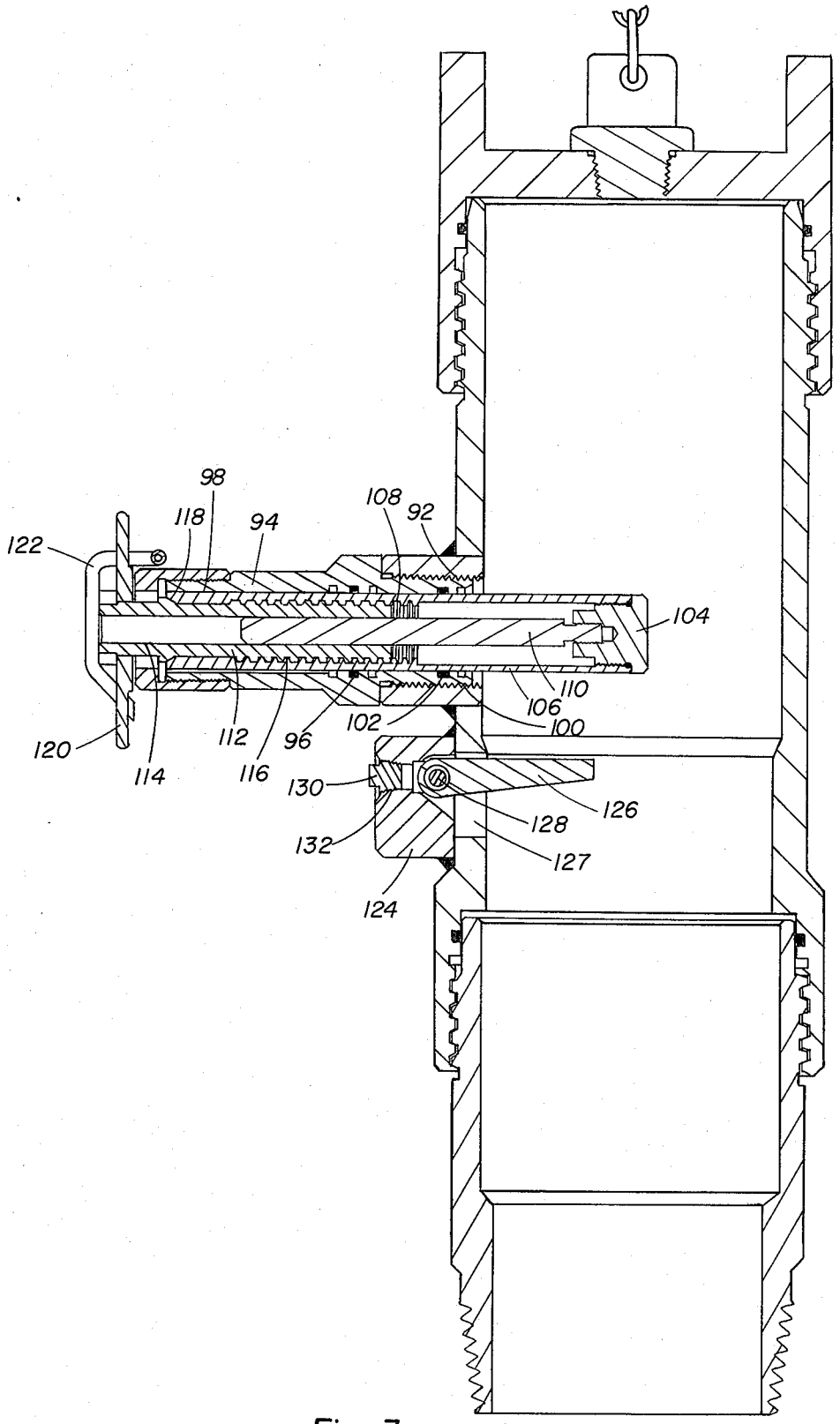
FIG. 3 is a cross-sectional view taken along line 3—3 of FIG. 1 of the present invention.

Referring to FIG. 3, the plug release plunger assembly 22 and plug release indicator assembly 24 are shown.

The plug release plunger assembly 22 is installed in internally threaded fitting 92 which is secured to plug body 12 by any suitable means, such as welding.

The plug release plunger assembly 22 comprises housing 94 having seal means 96 therein, having aperture 98 in one end thereof, and having the other end 100 thereof threadedly engaging internally threaded fitting 92, plunger sleeve 102 having closed end 104, having internal bore 106 having, in turn, a threaded portion 108 and having centering pin 110 therein, plunger pin 112 having bore 114 therein, having threaded exterior portion 116 thereon, having annular shoulder 118 thereon, having handle means 120 on one end thereof and having handle locking means 122 thereon.

The plug release indicator assembly 24 comprises housing 124, indicator lever means 126 extending through slot 127 in plug body 12, pin means 128 pivotally retaining indicator lever means 126 thereon and being received in apertures in the housing 124, and plug means 130 releasably threadedly engaging aperture 132 in the housing 124.

It should be understood that any suitable plug release plunger assembly and plug release indicator assembly may be utilized in the plug container 10.

It should also be evident from the foregoing that, in contrast to the prior art plug containers discussed hereinbefore, the plug container 10 of the present invention has the flow of fluid which includes cement through fluid inlets 20 into the plug body 12 entering at an acute angle of approximately forty-five degrees (45°) with respect to the bore of the plug body 12 through which the cementing plug passes. In this manner, the fluid entering the plug body 12 through the fluid inlets 20 and the fluid flow within the plug body 12 is directed through the open end of the plug body 12 and will tend to cause the cementing plug to flow downwardly through the plug body 12 once it has been released by the plug release plunger assembly 22. It should be understood that although the fluid inlets 20 have been shown as entering the plug body 12 at an acute angle of approximately forty-five degrees (45°), the acute angle could vary from essentially almost approximately a ninety degree (90°) angle to an acute angle which would approach having the fluid inlets 20 entering approximately parallel to the bore of the plug body 12. The more closely the fluid inlet 20 enters the plug body 12 at an angle which approaches paralleling the bore of the plug body 12 through which the cementing plug passes, the greater the fluid forces will be on the cementing plug during well cementing operations causing the same to pass through the plug body 12 after being released by the plug release plunger assembly 22.

Having thus described my invention, I claim:

1. A plug container for use in well cementing operations having one end thereof secured to the pipe being cemented in said well, said plug container comprising:

plug body means having a central bore therethrough, having a plurality of apertures therein, and having a plurality of fluid inlet ports therein, each fluid inlet port entering said plug body means at an acute angle with respect to the axis of the central bore of said plug body means;

fluid inlet conduit means, each fluid inlet conduit means being secured to said plug body means communicating with a fluid inlet port of the plurality of fluid inlet ports, each fluid inlet conduit means comprising:

arcuate shaped fluid inlet conduit means having one end secured to said plug body means communicating with a fluid inlet port of the plurality of fluid inlet ports, having connection means on the other end thereof and having removable protector means thereon for releasably engaging the connection means to protect the connection means from damage when not in use;

plug body nipple means having one end secured to the other end of said plug body means and having the other end thereof secured to one end of said pipe being cemented in said well;

plug release plunger assembly means secured to said plug body means having a portion thereof extensible into the bore of said plug body means through an aperture therein of the plurality of apertures therein;

plug release indicator assembly means secured to said plug body means comprising housing means, pin means rotatably mounted in the housing means, and lever means extending through an aperture in said plug body means and being secured to the pin means; and reinforcing means secured to said plug body means and said fluid inlet conduit means.

2. The plug container of claim 1 wherein the acute angle for entry of said plurality of fluid inlet ports comprises substantially forty-five degrees.

3. The plug container of claim 1 wherein the arcuate shaped fluid inlet conduit means having a substantially ninety-degree angular portion therein.

* * * * *